US006016586A

United States Patent [19]

Hsu

[11] Patent Number: 6,016,586

[45] Date of Patent: Jan. 25, 2000

[54] DUSTER STRUCTURE THAT CAN BE POSITIONED IN ANY DIRECTION

[76] Inventor: Hsing-Yuan Hsu, No.274, Lane 325, Sec. 3, Yuan JYI Road, Tien Chung Town, Chang Hua Hsien, Taiwan

[21] Appl. No.: 09/200,760

[22] Filed: Nov. 27, 1998

Related U.S. Application Data

[63] Continuation-in-part of application No. 09/074,392, May 18, 1998.

[51] Int. Cl.[7] ..... A47L 13/38; B25G 1/06

[52] U.S. Cl. ..... 15/144.1; 15/172

[58] Field of Search ..... 15/144.1, 172, 15/234

[56] References Cited

U.S. PATENT DOCUMENTS

| | | | |
|---|---|---|---|
| 2,609,251 | 9/1952 | Haupt | 15/172 |
| 4,654,922 | 4/1987 | Chen | 15/172 |
| 5,414,889 | 5/1995 | Sartori | 15/172 |
| 5,673,453 | 10/1997 | Huang | 15/172 |

*Primary Examiner*—Randall E. Chin
*Attorney, Agent, or Firm*—Bacon & Thomas

[57] ABSTRACT

A duster structure that can be positioned in any direction including a duster body, a retaining connector provided lockably at a rear end of the duster body, a front fork connector connected lockably with the retaining connector as a whole by means of a locking bolt, and a retractable rod provided lockably at a rear end of the front fork connector. The duster body has a handle at its rear end to connect to the retaining connector. The retaining connector has a circular flat pivot portion that has a central through hole and a plurality of retaining grooves extending radially outward from the through hole. The front forked connector has a forked portion, opposite inner portions of which are respectively provided with a retaining rib for engaging a respective one of the retaining grooves. By means of the retaining ribs that engage the retaining grooves, the retaining connector, hence the duster body, can be turned with respect to the front fork connector in any direction to facilitate cleaning.

3 Claims, 5 Drawing Sheets

DUSTER STRUCTURE THAT CAN BE POSITIONED IN ANY DIRECTION

This application is a Continuation-in-part of nonprovisional application number 09/074,392 filed May 8, 1998, now pending.

BACKGROUND OF THE INVENTION

1. Field of the Invention

The present invention relates generally to a duster structure that can be positioned in any direction, and more particularly to a duster structure in which a duster body can be turned about any angle to achieve cleaning of dead corners or tops of cabinets, wardrobes and the like in an easy and convenient manner.

2. Description of the Prior Art

Feather dusters were commonly used in cleaning up in the past. However it is inconvenient to use feather dusters to clean large areas or things at higher levels, and stools or ladders are required, which may be dangerous. There has been developed a kind of cleaning device with a replaceable cleaning layer. The bottom portion of such a cleaning device is a planar foamed pad having a soft sleeve on a top side. The soft sleeve has serrations and pawl-shaped toothed grooves. A cleaning cloth is placed below the foamed pad and the excess portions are folded upwardly and squeezed in the toothed grooves of the soft sleeve so that the cleaning cloth will not become detached from the foamed pad. However, a cleaning device as such is chiefly suitable for cleaning floors and ceilings. But tops of cabinets, wardrobes and the like, it is not usable since it is not provided with a bendable handle or rod.

SUMMARY OF THE INVENTION

A primary object of the present invention is to provide a duster structure that can be positioned in any direction. According to the present invention, a duster structure comprises a duster body, a retaining connector provided lockably at a rear end of the duster body, a front fork connector connected lockably with the retaining connector as a whole by means of a locking bolt, and a retractable rod provided lockably at a rear end of the front fork connector. The duster body has a handle at its rear end to connect to the retaining connector. The retaining connector has a circular flat pivot portion that has a central through hole and a plurality of retaining grooves extending radially outward from the through hole. The front forked connector has a forked portion, opposite inner portions of which are respectively provided With a retaining rib for engaging a respective one of the retaining grooves. By means of the retaining ribs that engage the retaining grooves, the retaining connector hence the duster body, can be turned with respect to the front fork connector in any direction to facilitate cleaning.

BRIEF DESCRIPTION OF THE DRAWINGS

The foregoing and other features and advantages of the present invention will be more clearly understood from the following detailed description and the accompanying drawings, in which.

FIG. 4A is an enlarged view of a retaining connector and a front fork connector of the second preferred embodiment in part.

DETAILED DESCRIPTION OF THE PREFERRED EMBODIMENT

Figure 1:
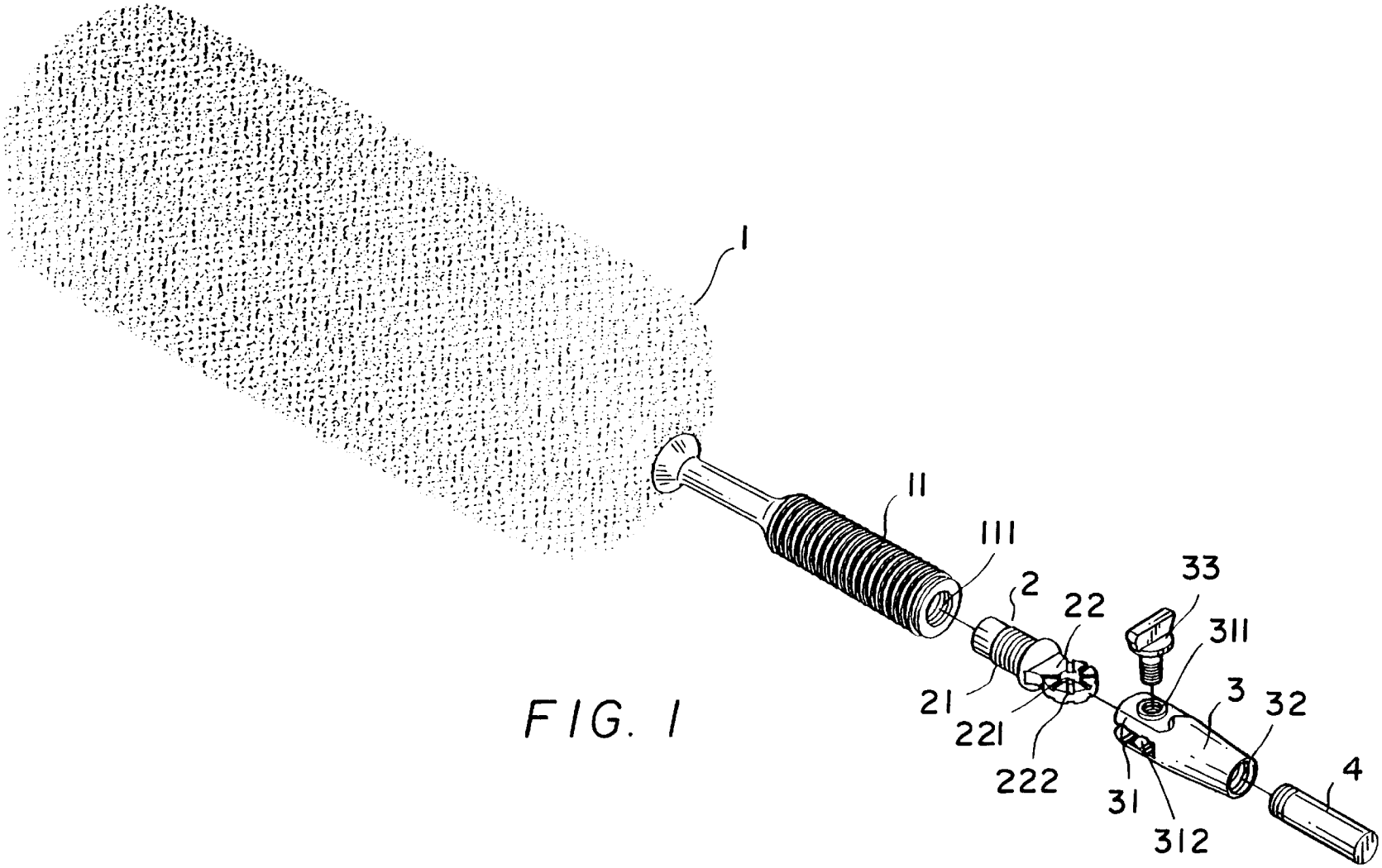
FIG. 1 is a perspective exploded view of the first preferred embodiment of the present invention.
Figure 2:
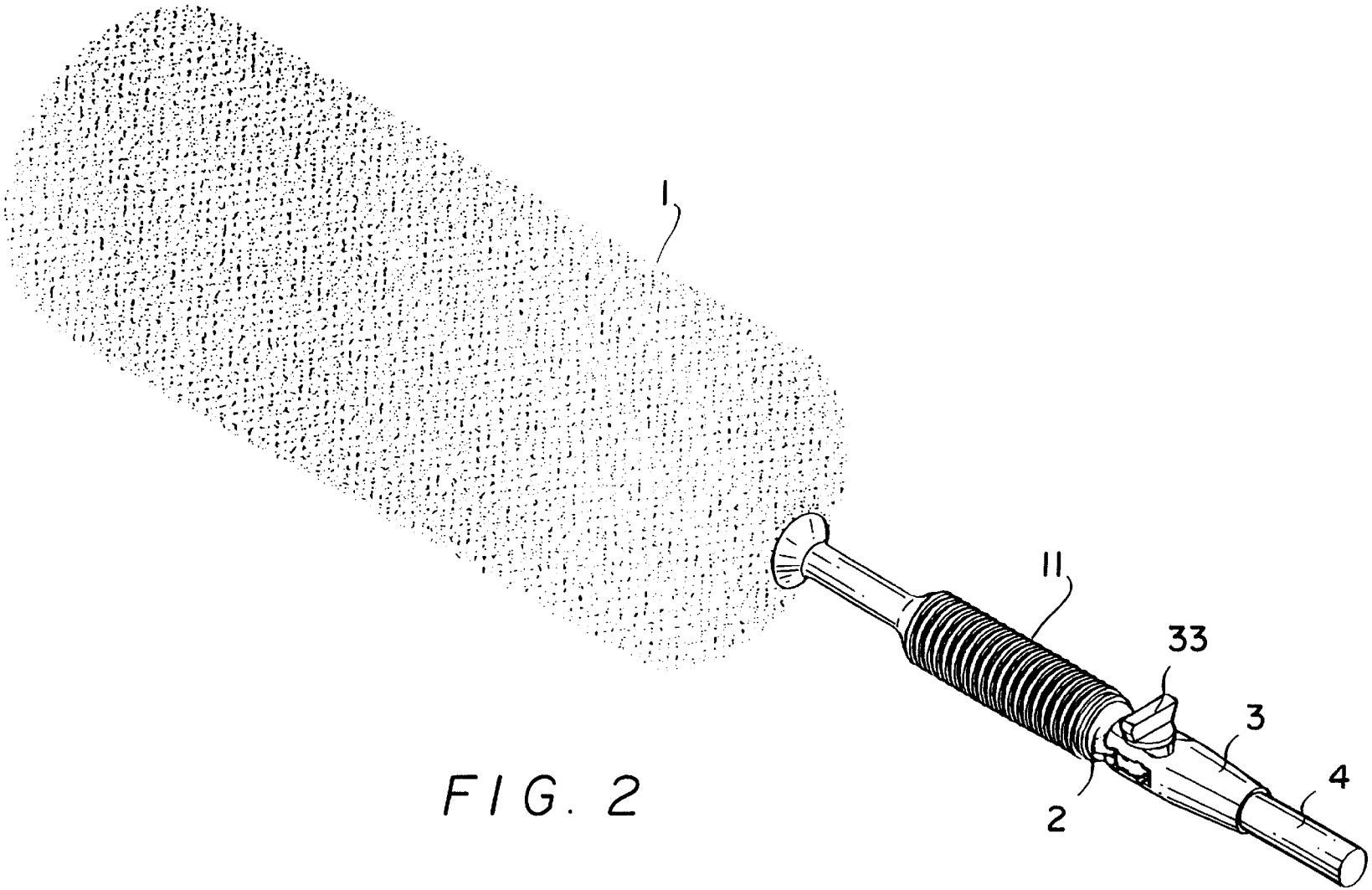
FIG. 2 is a perspective assembled view of the first preferred embodiment.

With reference to FIGS. 1 and 2, the first preferred embodiment of a duster structure that can be positioned in any direction according to the present invention is shown to comprise a duster body 1, a retaining connector 2 provided lockably at a rear end of the duster body 1, a front fork connector 3 connected lockably with the retaining connector 2 as a whole by means of a locking bolt 33, and a retractable rod 4 provided lockably at a rear end of the front fork connector 3.

The duster body 1 has a handle 11 at its rear end. The handle 11 is hollow and has female threads 111 adapted to engage male threads 21 of the retaining connector 2.

The retaining connector 2 has the above-mentioned male threads 21 at one end thereof. The other end thereof is a circular flat pivot portion 22. The pivot portion 22 is centrally provided with a through hole 221, and a plurality of retaining grooves 222 extending radially outward from the through hole 221. The retaining grooves 222 are provided to receive retaining ribs 312 of the front fork connector 3.

The front fork connector 3 is provided with inner threads 32 at one end and a forked portion 31 at the other. The forked portion 31 is provided with a locking screw hole 311 on one side. The locking bolt 33 is passed through the locking screw hole 311 and the through hole 221 to lock the retaining connector 2 and the front fork connector 3 tightly as a whole. In addition, opposite inner sides of the forked portion 31 are respectively provided with the abovementioned retaining ribs 312 for engaging the retaining grooves 222 of the retaining connector 2.

The retractable rod 4 is locked screwable at the rear end of the front fork connector 3 adapted to extend the length of the duster of the present invention when desired.

Figure 5:
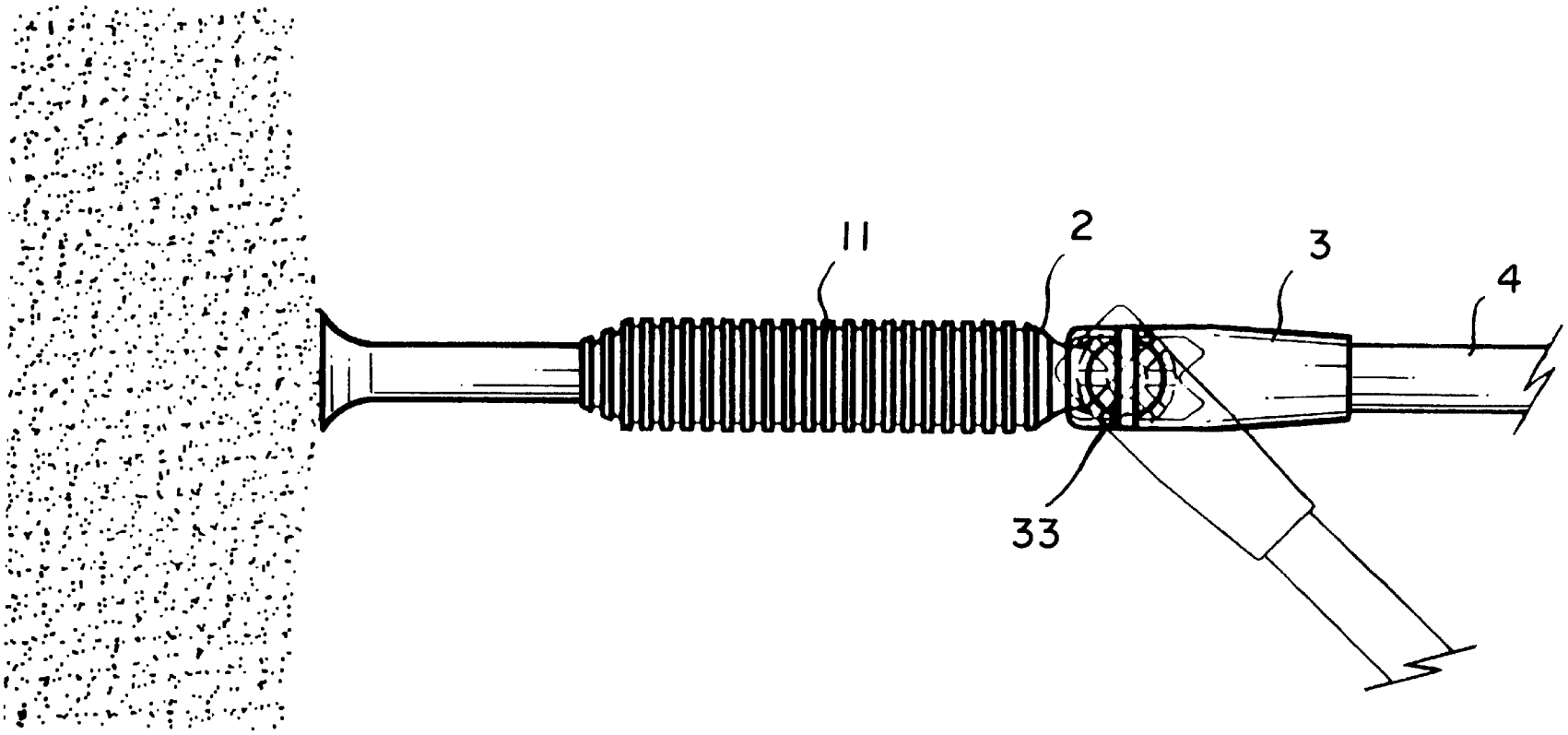
FIG. 5 is a schematic view illustrating operation of the present invention.

Referring to FIG. 5, the retaining ribs 312 can engage different retaining grooves 222 so that the retaining connector 2 and the front fork connector 3 can change directly freely. The retaining connector 2 is always retained in position by the front fork connector 3 at every change of angle so that the duster body 1 can be turned in all directions.

Figure 3:
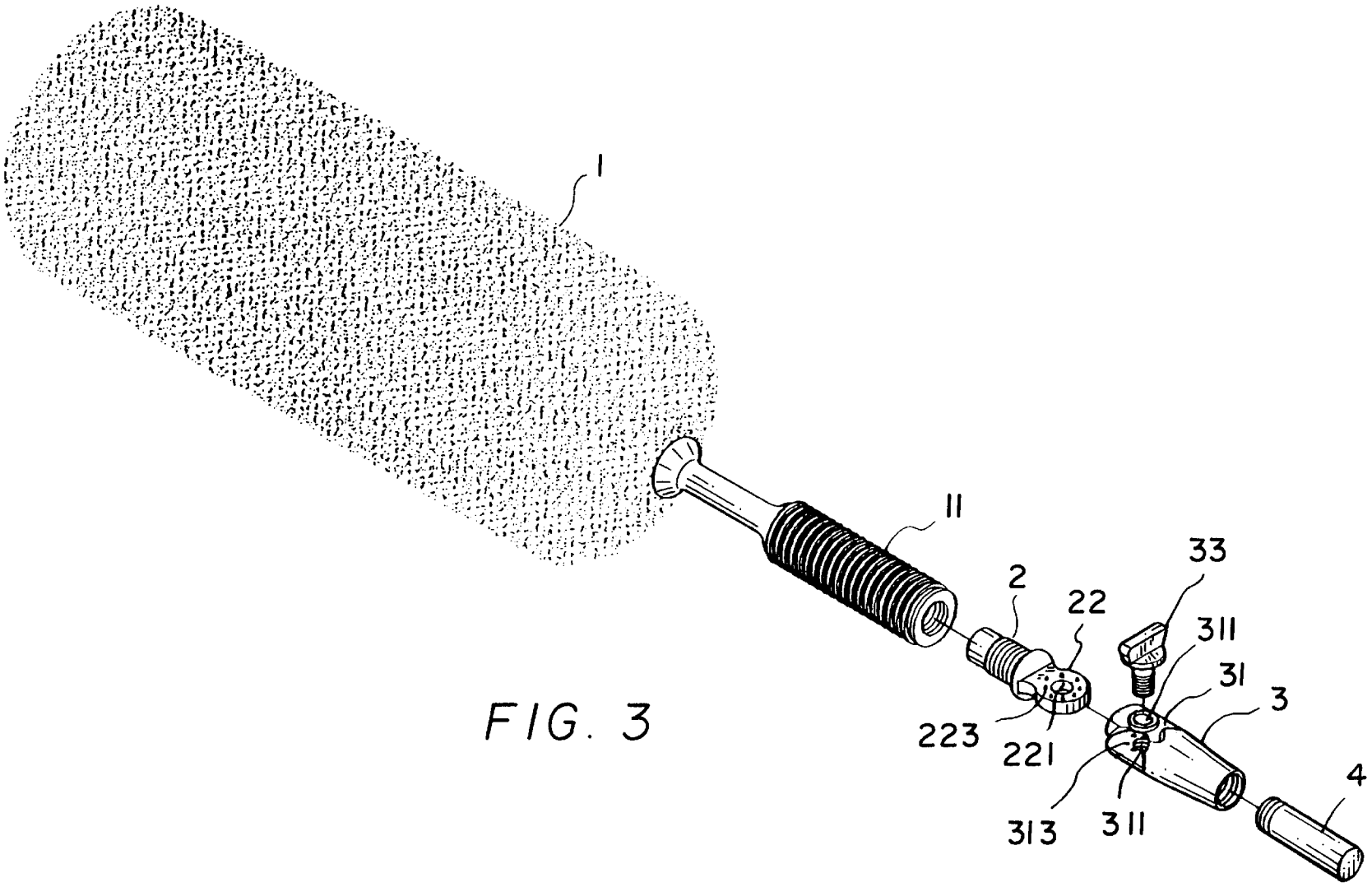
FIG. 3 is a perspective exploded view of the second preferred embodiment of the present invention.
Figure 4:
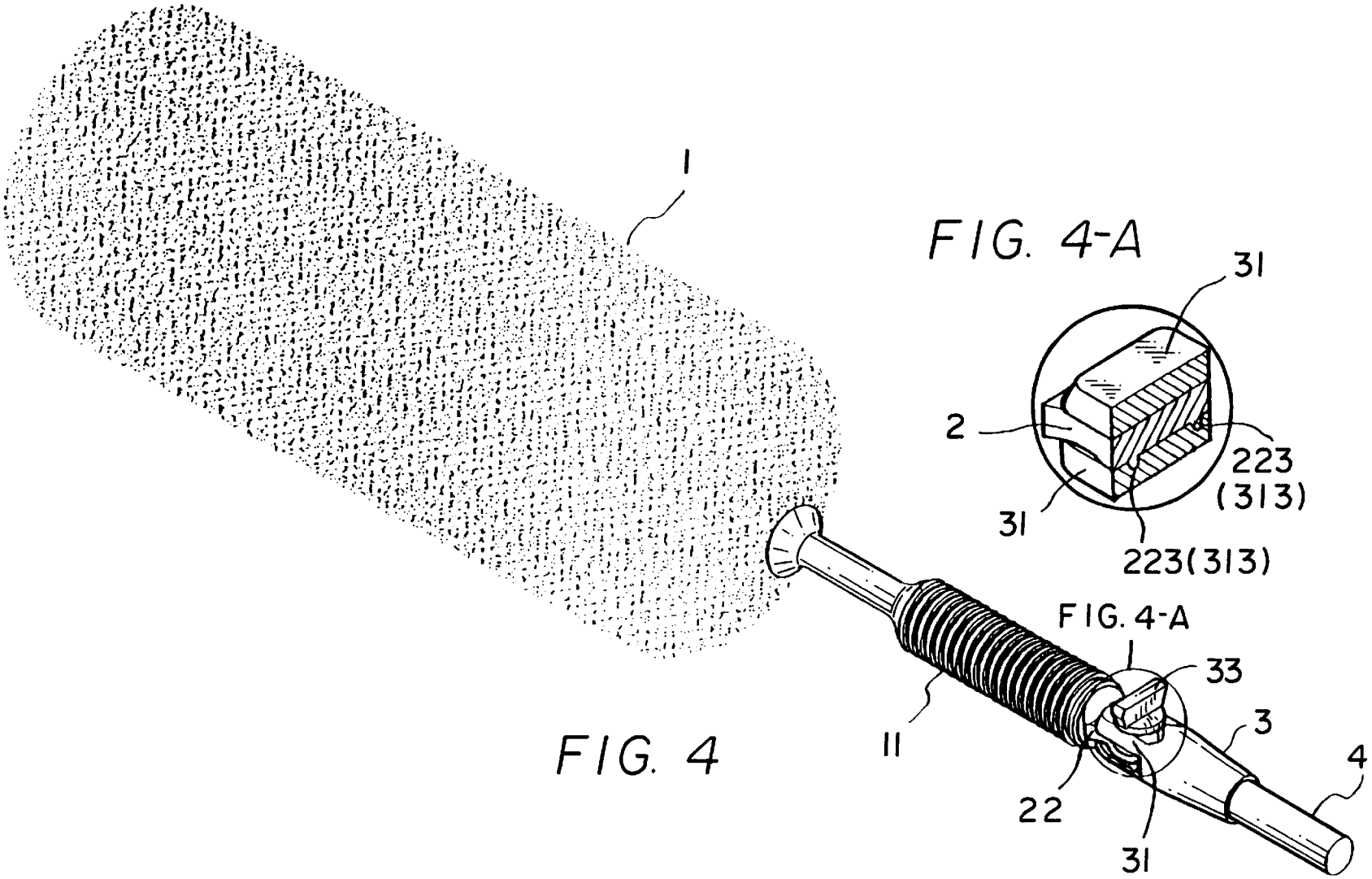
FIG. 4 is a perspective assembled view of the second preferred embodiment.

Referring to FIGS. 3, 4, and 5, which illustrate another preferred embodiment of the present invention, a plurality of spaced apart retaining bulges 223 are distributed around the through hole 221 of the pivot portion 22 of the retaining connector 2. (In FIG. 3, in order to illustrate clearly the retaining bulges 223 on the pivot portion 22, they are shown to orient upwardly apparently although they actually orient downwardly, as shown in FIG. 4A). to match the arrangement of the retaining bulges 223, a plurality of spaced apart retaining indentations 313 are distributed around the locking screw hole 311 on the inner side of the bottom portion of the front fork connector 3.

By means of the retaining bulges 223 of the retaining connector 2 that engage the retaining indentations 313 of the front fork connector 3, the retaining connector 2 can be turned in any direction with respect to the front fork connector 3, and the former is always retained in position by the front fork connector 3 at every change of angle so that the duster body 1 can turn in any direction. Thus, the duster of the present invention can be used to clean up tops of cabinets, wardrobes or dead corners in the house in a very convenient manner, without requiring the assistance of ladders or stools.

Although the present invention has been illustrated and described with reference to the preferred embodiment thereof, it should be understood that it is in no way limited to the details of such embodiment but is capable of numerous modifications within the scope of the appended claims.

What is claimed is:

1. A duster structure that can be positioned in any direction, comprising a duster body, a retaining connector provided lockably at a rear end of said duster body, a front fork connector connected lockably with said retaining connector as a whole by means of a locking bolt, and a retractable rod provided lockably at a rear end of said front fork connector, wherein said duster body has a handle at a rear end thereof, said handle being provided with female threads for engaging one end of said retaining connector;

said retaining connector is connected screwably with said duster body at one end, and has a flat pivot portion at the other end, said pivot portion being centrally provided with a through hole, with a plurality of retaining grooves extending radially outward from said through hole; and said front fork connector includes a forked portion at one end, and is connected screwably with said retractable rod at the other end, said forked portion having a locking screw hole on one side adapted for passage of said locking bolt that locks said retaining connector and said front fork connector tightly together, said forked portion further having a retaining rib on each of opposite inner sides thereof for receiving a respective one of said retaining grooves of said retaining connector, whereby said duster body can be turned about any angle with respect to said front fork connector to achieve cleaning of dead corners or tops of cabinets, wardrobes and the like in an easy and convenient manner.

2. A duster structure that can be positioned in any direction as defined in claim 1, wherein said pivot portion of said retaining connector is alternatively provided with a plurality of spaced retaining bulges arranged around said through hole.

3. A duster structure that can be positioned in any direction as defined in claim 1, wherein said forked portion of said front fork connector is alternatively provided with a plurality of spaced retaining indentations on an inner side of a bottom portion thereof.

* * * * *